US006926820B2

(12) United States Patent
Eldin et al.

(10) Patent No.: US 6,926,820 B2
(45) Date of Patent: Aug. 9, 2005

(54) INHIBITION OF VISCOSITY INCREASE AND FOULING IN HYDROCARBON STREAMS INCLUDING UNSATURATION

(75) Inventors: Sherif Eldin, Houston, TX (US); Grace B. Arhancet, Creve Coeur, MO (US)

(73) Assignee: G.E. Betz, Inc., Trevose, PA (US)

( * ) Notice: Subject to any disclaimer, the term of this patent is extended or adjusted under 35 U.S.C. 154(b) by 270 days.

(21) Appl. No.: 10/251,564

(22) Filed: Sep. 20, 2002

(65) Prior Publication Data

US 2004/0055932 A1 Mar. 25, 2004

(51) Int. Cl.[7] ..... C10G 9/16

(52) U.S. Cl. ..... 208/48 AA; 585/950; 585/650; 208/48 R; 203/8

(58) Field of Search ..... 208/48 AA, 48 R; 585/950, 650; 203/8

(56) References Cited

U.S. PATENT DOCUMENTS

| | | | | | |
|---|---|---|---|---|---|
| 4,003,800 | A | | 1/1977 | Bacha et al. | |
| 4,040,911 | A | | 8/1977 | Bacha et al. | |
| 4,927,519 | A | | 5/1990 | Forester | |
| 5,583,247 | A | | 12/1996 | Nesvadba et al. | |
| 5,616,774 | A | | 4/1997 | Evans et al. | |
| 5,750,765 | A | * | 5/1998 | Nesvadba et al. | 560/126 |
| 5,824,829 | A | | 10/1998 | Maeda et al. | |
| 5,985,940 | A | | 11/1999 | Manek et al. | |
| 6,024,894 | A | * | 2/2000 | Arhancet | 252/404 |
| 2004/0010159 | A1 | * | 1/2004 | Benage | 558/306 |

FOREIGN PATENT DOCUMENTS

| | | |
|---|---|---|
| EP | 0 093 550 | 11/1983 |

* cited by examiner

*Primary Examiner*—Walter D. Griffin
(74) *Attorney, Agent, or Firm*—Hoffmann & Baron, LLP

(57) ABSTRACT

A method of inhibiting fouling and viscosity increase in hydrocarbon streams including ethylenically unsaturated monomers is disclosed. The method includes the step of adding to the hydrocarbon stream an effective amount of one or more quinone methides of the formula:

(I)

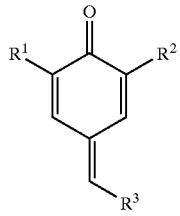

wherein $R^1$, $R^2$, and $R^3$ are independently selected from the group consisting of H, —OH, —SH, —$NH_2$, alkyl, cycloalkyl, heterocyclo, and aryl.

9 Claims, No Drawings

INHIBITION OF VISCOSITY INCREASE AND FOULING IN HYDROCARBON STREAMS INCLUDING UNSATURATION

FIELD OF THE INVENTION

The present invention relates to a method for preventing fouling or an increase in viscosity in a hydrocarbon stream including unsaturated monomers. More specifically, the invention relates to an online process for substantially preventing fouling or viscosity increase during ethylene production including the addition of a quinone methide.

BACKGROUND OF THE RELATED TECHNOLOGY

Ethylene (ethene) plants that crack liquid feeds produce cracked gases, pyrolysis gas oil and heavy pyrolysis fuel oil at high temperatures. This mixture passes through an oil quench tower (also known as primary fractionator or gasoline fractionator) where gases ($C_9$ and lighter) are cooled and separated from the heavy oils. The lighter separated material, rich in unsaturated hydrocarbons, is known as raw gasoline or py-gas oil. Py-gas oil is refluxed in the upper section of the oil quench tower and its counter current flow cools cracked gases.

As the py-gas oil is subjected to heat, it increases in viscosity and the heavier components drop to the bottom section of the oil quench tower, leading to an increase in the viscosity of the hydrocarbon present in the bottom section of the tower and fouling. This is possibly as a result of polymerization of the unsaturated hydrocarbon components. Viscosity increase and fouling is problematic in that it can adversely affect the quality of the final product.

In an attempt to reduce viscosity in the bottom section of the tower, light cycle oil (LCO), and/or py-gas oil may be added to the tower, thereby reducing the viscosity by dilution. However, this procedure results in considerable expense for the plant operators. Therefore, other methods of preventing a viscosity increase have been proposed.

Various methods of chemical treatment have been proposed to prevent viscosity increase during ethylene production. These include the use of sulfonic acids or salts as proposed in U.S. Pat. No. 5,824,829 to Maeda et al. ("Maeda") and the use of phenylenediamines. It has been proposed to add these compositions to a hydrocarbon stream in order to prevent an increase in viscosity. However, while these compositions have been suggested to be inhibitors of polymerization, they generally are used in combination with other chemical treatments or in combination with the addition of py-gas oil or LCO to adequately prevent the increase of viscosity of the hydrocarbon mixtures.

Another method of mitigating fouling and reducing viscosity is proposed in U.S. Pat. No. 5,985,940 to Manek et al. ("Manek"). Manek proposes the use of mono- and/or polyalkyl-substituted phenol-formaldehyde resins.

Although polymerization of the components in the oil quench tower contributes to the increase of viscosity in the bottom section, compositions that inhibit the polymerization of a particular monomer do not necessarily prevent a viscosity increase in an oil quench tower or during ethylene production. This is demonstrated by examples of known vinyl monomer polymerization inhibitors that are ineffective in quench oil applications. One reason for this observation is that the hydrocarbons present in the bottom of the oil quench tower are a mixture of a variety of different monomers and other components. For example, these include a variety of compounds including a variety of unsaturated compounds, such as unsaturated aromatics, including, without limitation, styrene, methyl styrene, divinylbenzene, and indene.

Therefore, there is a need for other methods of inhibiting fouling and/or viscosity increase that provides an adequate results. Desirably, the method may be used during the operation of an ethylene plant and will provide a more cost-effective manner of preventing viscosity increase and fouling.

SUMMARY OF THE INVENTION

One aspect of the present invention provides a method of inhibiting fouling and viscosity increase in hydrocarbon streams including ethylenically unsaturated monomers. This method provides adequate results exclusive of any additional method for the inhibition of viscosity increase. This method includes the step of adding to the hydrocarbon stream an effective amount of a quinone methide of the formula:

(I)

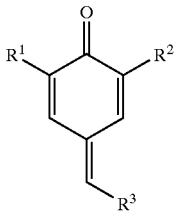

wherein $R^1$, $R^2$, and $R^3$ are independently selected from the group consisting of H, —OH, —SH, —$NH_2$, alkyl, cycloalkyl, heterocyclo, and aryl.

Another aspect of the present invention provides a method of inhibiting fouling and viscosity increase of a hydrocarbon stream including ethylenically unsaturated monomers during online production of ethylene. This method includes the step of adding to the hydrocarbon stream at or upstream of a location where the fouling or viscosity increase may occur an effective amount of a quinone methide of the following formula:

(I)

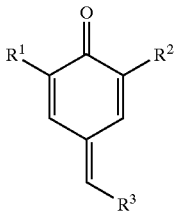

wherein $R^1$, $R^2$, and $R^3$ are independently selected from the group consisting of H, —OH, —SH, —$NH_2$, alkyl, cycloalkyl, heterocyclo, and aryl.

DETAILED DESCRIPTION OF THE INVENTION

A variety of different quinone methides may be used in the present invention. Among these are quinone methides of the following formula:

(I)

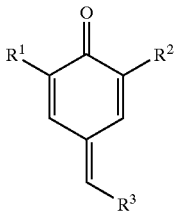

wherein $R^1$, $R^2$, and $R^3$ are independently selected from the group consisting of H, —OH, —SH, —$NH_2$, alkyl, cycloalkyl, heterocyclo, and aryl.

The term "alkyl" is meant to include optionally substituted, straight and branched chain saturated hydrocarbon groups, desirably having 1 to 10 carbons, or more desirably 1 to 4 carbons, in the main chain. Examples of unsubstituted groups include methyl, ethyl, propyl, isopropyl, n-butyl, t-butyl, isobutyl, pentyl, hexyl, isohexyl, heptyl, 4,4-dimethyl pentyl, octyl, 2,2,4-trimethylpentyl, nonyl, decyl, undecyl, dodecyl, and the like. Substituents may include halogen, hydroxy, or aryl groups.

The terms "heterocyclo" or "heterocyclic" are meant to include optionally substituted fully saturated or unsaturated, aromatic or non-aromatic cyclic groups having at least one heteroatom (such as N, O, and S) in at least one ring, desirably monocyclic or bicyclic groups having 5 or 6 atoms in each ring. The heterocyclo group may be bonded through any carbon or heteroatom of the ring system. Examples of heterocyclic groups include, without limitation, thienyl, furyl, pyrrolyl, pyridyl, imidazolyl, pyrrolidinyl, piperidinyl, azepinyl, indolyl, isoindolyl, quinolinyl, isoquinolinyl, benzothiazolyl, benzoxazolyl, benzimidazolyl, benzoxadiazolyl, and benzofurazanyl. These may also contain substituents as described above.

The term "aryl" is meant to include optionally substituted homocyclic aromatic groups, preferably containing one or two rings and 6 to 12 ring carbons. Examples of such groups include phenyl, biphenyl, and naphthyl. Substituents may include those as described above as well as nitro groups.

Examples of specific quinone methides include 2,6-di-tert-butyl-4-((3,5-di-tert-butyl-4-hydroxy-benzylidene)-cyclohexa-2,5-dienone, also known as Galvinol, formula (II) and 4-benzylidene-2,6-di-tert-butyl-cyclohexa-2,5-dienone, formula (III).

(II)

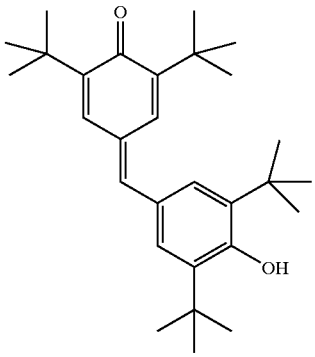

(III)

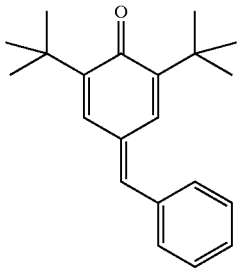

In the present invention, a single quinone methide may be used, or it may be used in combination with different quinone methides. The quinone methide composition may be added at or upstream of any point where viscosity increase or fouling may occur. This includes either to the oil quench tower, specifically to the upper section and bottom section of the oil quench tower, or at any point upstream of the oil quench tower. Desirably, the composition is added during the ethylene production.

The composition of the present invention may be added in a variety of different concentrations. Based on the hydrocarbon present, the concentration may be from about 1 ppm to about 10,000 ppm.

The addition of a quinone methide composition as described above achieves a decrease in viscosity and fouling compared to previous methods, such as the addition of LCO and py-gas oil. However, the addition of quinone methide may be in combination with the addition of LCO or py-gas oil, or in addition to the use of chemicals such as phenylenediamines and dispersants.

The features and advantages of the present invention are more fully shown by the following examples which are provided for purposes of illustration, and are not to be construed as limiting the invention in any way.

EXAMPLES

Each of the examples below was conducted using py-gas oil sample obtained from several ethylene plants. The samples were placed in a pressure vessel under and inert atmosphere (100 psi nitrogen), and heated at about 150° C. for specified periods of time. The pressure vessels were then allowed to cool to room temperature at which the polymer content (methanol precipitation) and viscosities (using Cannon-Fenske viscometers) of the samples were measured.

Example 1

Py-gas oil viscosity was measured at 20° C. after being heated at 150° C. for 7.5 hours. Three trials were performed; one blank, the second with 1000 ppm phenylenediamine, and the third according to the inventive method including 1000 ppm of the quinone methide of formula (II), above. Table 1 below demonstrates that the viscosity of the py-gas oil after treatment with the inventive quinone methide was 43.6% less than after treatment with phenylenediamine alone, and 55.1% less than the blank after the py-gas oil was subjected to conditions simulating those in an oil quench tower.

TABLE 1

| Treatment Name | Viscosity (cst) |
|---|---|
| Blank | 4.9 |
| PDA (44 PD[1]) | 3.9 |
| Quinone Methide (II) | 2.2 |

[1]N,N'-di-sec-butyl-p-phenylenediamine available from Flexsys

Example 2

Py-gas oil viscosity at 23° C. was measured after being heated at 144° C. for six hours with the amounts of treatment listed in Table 2. This demonstrates that up to a concentration of 2000 ppm, a greater concentration of the inventive quinone methide treatment provides an enhanced inhibition of viscosity increase.

TABLE 2

| Quinone Methide (II) Treatment (ppm) | Viscosity (cst) |
|---|---|
| 0 | 1.63 |
| 500 | 1.39 |
| 1000 | 1.20 |
| 2000 | 1.13 |

Example 3

The polymer content in py-gas oil samples was measured by methanol precipitation after heating at 150° C. for 7.5 hours. Three trials were performed; one blank, the second with 1000 ppm phenylenediamine, and the third according to the inventive method including 1000 ppm of the quinone methide of formula (II), above. The results in Table 3 indicate that the polymer content of the py-gas oil samples after treatment with the inventive quinone methide was 32.3% less than the after treatment with phenylenediamine alone, and 40.0% less than the blank after the py-gas oil was subjected to conditions simulating those in an oil quench tower.

TABLE 3

| Treatment Name | Polymer Content % |
|---|---|
| Blank | 4.0 |
| PDA (44 PD[1]) | 3.1 |
| Quinone Methide (II) | 2.4 |

[1]N,N'-di-sec-butyl-p-phenylenediamine available from Flexsys

Example 4

The polymer content in py-gas oil samples was measured by methanol precipitation after heating at 144° C. for six hours with the amounts of treatment listed in Table 4. This demonstrates that up to a concentration of 2000 ppm, a greater concentration of the inventive quinone methide treatment provides an enhanced inhibition of polymerization of the hydrocarbon present in py-gas oil, under conditions simulating those of an oil quench tower.

TABLE 4

| Quinone Methide (II) Treatment (ppm) | Polymer Content (%) |
|---|---|
| 0 | 2.82 |
| 500 | 2.35 |
| 1000 | 1.66 |
| 2000 | 0.75 |

Example 5

The polymer content in py-gas oil samples was measured by methanol precipitation after heating at 150° C. for 8.0 hours. One blank sample and samples including 1000 ppm of the treatment specified in Table 5 were tested. Table 5 below demonstrates that the polymer content of the samples treated with the inventive quinone methides of formulas (II) and (III) were significantly less than those of the samples treated with the phenylenediamines.

TABLE 5

| Treatment Name | Polymer Content (%) |
|---|---|
| Blank | 2.19 |
| OH-Tempo[1] | 2.18 |
| PDA (7 PPD[2]) | 1.75 |
| PDA (44 PD[3]) | 1.13 |
| Quinone Methide (III) | 0.68 |
| Quinone Methide (II) | 0.66 |

[1]4-hydroxy-2,2,6,6-tetramethyl-1-piperidinyloxy, free radical
[2]N-(1,4-dimethylpentyl)-N'-phenyl-p-phenylenediamine, available from Flexsys
[3]N,N'-di-sec-butyl-p-phenylenediamine available from Flexsys While there have been described what are presently believed to be the preferred embodiments of the invention, those skilled in the art will realize that changes and modifications may be made thereto without departing from the spirit of the invention, and it is intended to include all such changes and modifications as fall within the true scope of the invention.

What is claimed is:

1. A method of inhibiting fouling and viscosity increase in hydrocarbon streams including ethylenically unsaturated monomers comprising the step of adding to said hydrocarbon stream during ethylene production an effective amount of one or more quinone methides of the formula:

(I)

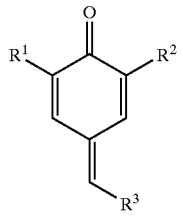

wherein $R^1$, $R^2$, and $R^3$ are independently selected from the group consisting of H, —OH, —SH, —$NH_2$, alkyl, cycloalkyl, heterocyclo, and aryl.

2. The method of claim 1, wherein said quinone methide is added to said hydrocarbon stream at or upstream of a location where said fouling or said viscosity increase may occur.

3. The method of claim 2, wherein said location is an oil quench tower.

4. The method of claim 1, wherein said quinone methide is added in an amount from about 1 ppm to about 10,000 ppm based on the hydrocarbon.

5. The method of claim 1, wherein said quinone methide is a member selected from the group consisting of 2,6-di-tert-butyl-4-((3,5-di-tert-butyl-4-hydroxy-benzylidene)-cyclohexa-2,5-dienone, 4-benzylidene-2,6-di-tert-butyl-cyclohexa-2,5-dienone and combinations thereof.

6. A method of inhibiting fouling and viscosity increase of a hydrocarbon stream including ethylenically unsaturated monomers during online production of ethylene comprising the step of adding to said hydrocarbon stream at or upstream of a location where said fouling or said viscosity increase may occur an effective amount of a quinone methide of the following formula:

(I)

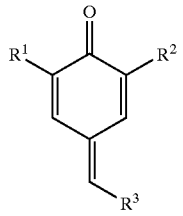

wherein $R^1$, $R^2$, and $R^3$ are independently selected from the group consisting of H, —OH, —SH, —$NH_2$, alkyl, cycloalkyl, heterocyclo, and aryl.

7. The method of claim 6, wherein said location is an oil quench tower.

8. The method of claim 6, wherein said location is the bottom section of an oil quench tower.

9. The method of claim 6, wherein said quinone methide is a member selected from the group consisting of 2,6-di-tert-butyl-4-((3,5-di-tert-butyl-4-hydroxy-benzylidene)-cyclohexa-2,5-dienone, 4-benzylidene-2,6-di-tert-butyl-cyclohexa-2,5-dienone and combinations thereof.

* * * * *